United States Patent [19]

John

[11] Patent Number: 5,060,571

[45] Date of Patent: Oct. 29, 1991

[54] INKER WITH CONTROLLED ZONE INK DISTRIBUTION, AND METHOD OF CONTROLLING INK TRANSFER BETWEEN CYLINDERS OF A PRINTING MACHINE

[75] Inventor: Thomas John, Augsburg, Fed. Rep. of Germany

[73] Assignee: Man Roland Druckmaschinen AG, Offenbach am Main, Fed. Rep. of Germany

[21] Appl. No.: 593,039

[22] Filed: Oct. 5, 1990

[30] Foreign Application Priority Data

Nov. 18, 1989 [DE] Fed. Rep. of Germany ..... 3938447

[51] Int. Cl.[5] ..... B41F 31/06; B41F 31/36

[52] U.S. Cl. ..... 101/350; 101/483

[58] Field of Search ..... 101/207-210, 101/148, 349, 350, 351, 352, 363, 483, 493; 118/258, 259, 261, 262

[56] References Cited

U.S. PATENT DOCUMENTS

| | | | |
|---|---|---|---|
| 4,290,362 | 9/1981 | Köbler et al. | 101/350 |
| 4,363,288 | 12/1982 | Fara | 101/350 X |
| 4,372,244 | 2/1983 | Rebel | 118/46 |
| 4,455,938 | 6/1984 | Loudon | 101/363 X |
| 4,643,090 | 2/1987 | McKrell et al. | 101/218 |
| 4,805,530 | 2/1989 | Kobler | 101/350 |

FOREIGN PATENT DOCUMENTS

| | | | |
|---|---|---|---|
| 741828 | 11/1943 | Fed. Rep. of Germany . | |
| 1761715 | 4/1972 | Fed. Rep. of Germany . | |
| 2210020 | 9/1972 | Fed. Rep. of Germany | 101/350 |
| 3046257 | 6/1982 | Fed. Rep. of Germany . | |
| 3704433 | 8/1988 | Fed. Rep. of Germany . | |
| 3706011 | 9/1988 | Fed. Rep. of Germany . | |
| 3800411 | 10/1989 | Fed. Rep. of Germany . | |

*Primary Examiner*—J. Reed Fisher

*Attorney, Agent, or Firm*—Frishauf, Holtz, Goodman & Woodward

[57] ABSTRACT

To control the amount of ink transferred between an ink application cylinder (2) and an ink supplying cylinder (1) having a cellular surface, such as an anilox roller or another roller or cylinder having ink receptor cells and/or a further cylinder (3) such as a plate cylinder, the ink application cylinder (2) is formed with a yieldingly compressible surface and the yieldingly compressible surface is pre-compressed by application of a surface compression roller (4) thereagainst. The surface compression roller (4) deforms the yieldingly compressible surface (14) which does not expand instantaneously; it may be located in advance of engagement with the ink supplying cylinder (1) or with the plate cylinder (3) by a distance shorter than the decay distance of the compression effected by the surface compression roller. A plurality of such pre-surface compression rollers may be provided, located axially adjacent each other, to control the amount of ink being transfered to the plate cylinder in axially adjacent zones.

20 Claims, 4 Drawing Sheets

INKER WITH CONTROLLED ZONE INK DISTRIBUTION, AND METHOD OF CONTROLLING INK TRANSFER BETWEEN CYLINDERS OF A PRINTING MACHINE

Reference to related patents and applications assigned to the assignee of the present application: U.S. Ser. No. 07/607,533, filed Nov. 1, 1990, JOHN; U.S. Ser. No. 07/604,772, filed Oct. 26, 1990, JOHN; U.S. Ser. No. 07/593,040, filed Oct. 5, 1990, JOHN.

U.S. Pat. No. 4,805,530, KOBLER et al (to which German 37 06 011 corresponds); U.S. Pat. No. 4,938,133, Bock et al, Reference to related literature:

Glück: "Untersuchung des Rollverhaltens von Mehrwalzen-Systemen unter Einbeziehung einer viskoelastischen Walze" ("Investigation of Behavior of Rollers including a Viscous Elastic Roller in Multi-Roller Systems"), TH Darmstadt (Technical University Darmstadt), 1976; page 166 et seq.

FIELD OF THE INVENTION

The present invention relates to an inker and to a method of inking cylinders of a printing machine, and more particularly to an inker having a cylinder with a cellular surface, such as an anilox cylinder or roller and, further, an ink transfer roller or cylinder which has a soft or resiliently yielding, compressible surface, to transfer ink from the cylinder with the cellular surface to a further cylinder, for example a plate cylinder or the like.

DEFINITION

The term "cellular surface" will be used hereinafter to describe an ink transfer surface having small ink receptor depressions or cells, which are used, for example, in anilox rollers or cylinders, gravure cylinders or the like.

BACKGROUND

An inker with an anilox roller with a compressible surface transferring ink to a transfer cylinder, is described for example, in the referenced U.S. Pat. No. 4,805,530, to which German Patent 37 06 011 corresponds. In accordance with this reference, the cellular surface roller has a compressible layer; by controlling the compression, the quantity of ink transferred to a plate cylinder can be controlled. The layer is compressed by a doctor blade or similar stripper element. Compressing the compressible layer by a doctor blade causes substantial wear and tear on the cellular roller or cylinder.

THE INVENTION

It is an object to provide an inker in which the quantity to be transferred by the inker can be controlled, and to a method of controlling this quantity, in which the respective rollers or cylinders of the inker have substantially less wear than in prior art structures.

Briefly, an ink transfer cylinder is provided which has a yieldingly compressible surface. The ink transfer cylinder is in ink transfer relation with an ink supplying cylinder which has a cellular surface. The ink transfer cylinder is in engagement with a further cylinder, for example a forme or plate cylinder, to transfer ink thereto. In accordance with a feature of the invention, a surface compression roller is in engagement with the yielding compressible surface of ink transfer cylinder. The extent of compression applied by the surface compression roller is controllable to thereby control the amount of ink being transferred between the ink transfer cylinder and the further cylinder. The compression control provides for precompression of the yielding compressible layer in advance of contact of the ink transfer cylinder with the further, for example forme cylinder. This pre-compression permits the yieldingly compressible surface to expand for a limited controlled amount before engagement with the further cylinder.

In accordance with a feature of the invention, the surface compression roller can be placed in advance—with respect to the direction of rotation of the ink transfer cylinder—of engagement with the ink supplying cylinder having the cellular surface, or in advance of engagement with the further cylinder, for example the plate cylinder.

DRAWINGS

DETAILED DESCRIPTION.

Figure 1:
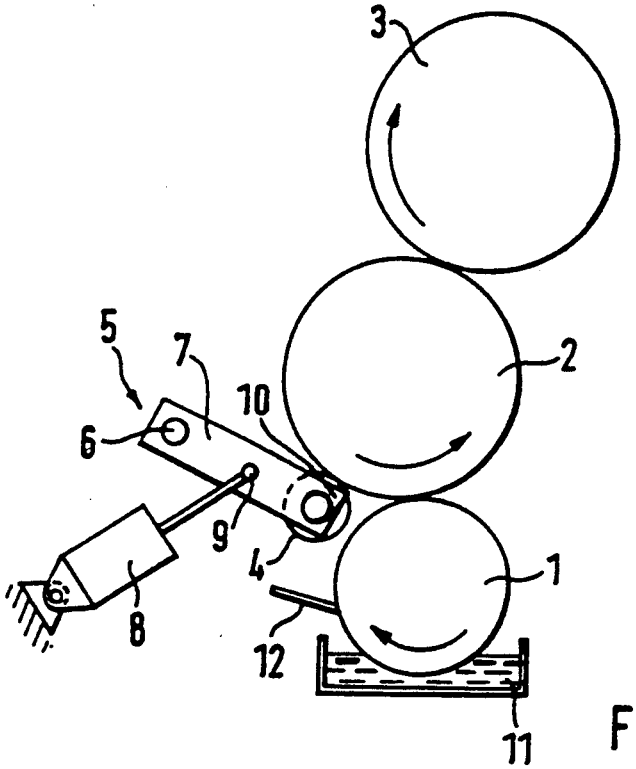
FIG. 1 is a highly schematic side view of an inker in accordance with the present invention.

The invention is directed to supplying ink to a printing machine cylinder, for example a plate or forme cylinder 3. FIG. 1 shows the inker having an ink supplying cylinder 1 with a cellular surface; for short, cylinder 1 will be referred to hereinafter as a "cellular" cylinder. Its surface is formed with small depressions or cells, which may, for example, be a hard surface. An ink transfer cylinder 2 is in surface contact with the cellular cylinder 1. The ink transfer cylinder 2 has a resilient, yieldingly compressible surface. Ink removed by the cellular surface 1 from an ink trough 11 is transferred first on the ink transfer cylinder 2, and from the ink transfer cylinder 2 on the plate cylinder 3. The cellular cylinder 1 has ink stripped off therefrom by a doctor blade 12. The ink transfer cylinder can be an ink application cylinder.

In accordance with the present invention, an auxiliary roller or cylinder, forming a surface compression roller 4, is in controlled pressure engagement with the ink application cylinder 2.

The quantity of ink being transferred from one roller or cylinder to another roller or cylinder depends on the width of the engagement zones of the respectively engaged cylinders or rollers. The engagement zone is also referred to as an ink transfer or pressure zone. Reliable transfer of printing ink from one roller onto another is possible only when the respective rollers are in pressure contact engagement. The pressure is also applied on the ink within the engagement or ink transfer zone. The ink, thus, transfers from one roller to the other. Engagement, under pressure, results in elastic deformation of the surface of one of the rollers at the engagement or pressure zone.

The phenomenon of ink transfer has been studied, see Glück: "Untersuchung des Rollverhaltens von Mehrwalzen-Systemen unter Einbeziehung einer viskoelastischen Walze" ("Investigation of Behavior of Rollers including a Viscous Elastic Roller in Multi-Roller Systems"), TH Darmstadt (Technical University Darmstadt), 1976; page 166 et seq.

The above-referenced literature teaches that elastic jackets or sleeves which are compressed in a pressure zone require a predetermined period of time until the deformation is no longer effective. This time, forming what may be termed an elastic memory, can be referred to as the retardation time. Placing two pressure zones closely spaced from each other has the result that the remaining deformation resulting from the first pressure zone will have an effect on the deformation in the next pressure zone.

The present invention makes use of this phenomenon. If the deformation in the next pressure zone is smaller, less ink will be transferred thereby.

Under ordinary operating conditions, a first deformation followed by a second deformation is highly undesirable. To prevent a first deformation, for example due to engagement of a roller on an elastic surface of another roller, from having this effect, it is necessary to space the circumferential distance of the rollers sufficiently wide so that the compressible layer can expand to its nominal diameter.

In accordance with the present invention, this effect of a smaller deformation of a compressible layer subsequent to the first compression is used and is specifically caused, since it can be utilized to control the quantity of ink being transferred.

Referring again to FIG. 1:

The inker includes a system 5 which permits application of the surface compression roller 4 on the ink application cylinder 2 with controlled surface pressure. As shown in FIG. 1, the system 5, essentially, includes a lever 7 pivotable about a pivot 6. The surface compression roller 4 is located at the far end 10 of the lever 7. A fluid controlled piston-cylinder unit 8 is coupled intermediate the roller 4 and the pivot 6 on the link or lever 7. The piston-cylinder unit 8 secured, for example, to the side walls of the printing machine is so controlled that the lever 7, and hence the compression roller 4, is engaged against the ink application roller 2 with the yieldingly compressible surface, to cause a predetermined deformation of the surface of the roller 2 just in advance of its contact with the cellular cylinder 1.

Figure 2:
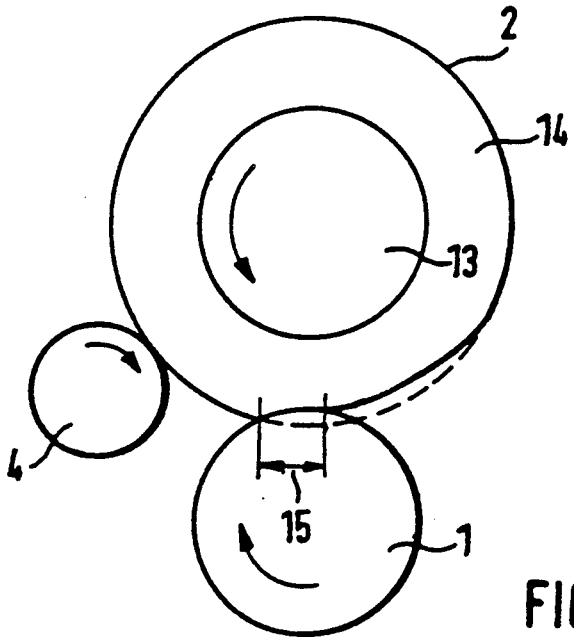
FIG. 2 is a schematic illustration showing the deformation of an ink application cylinder by an ink supplying cylinder with a cellular surface, with the surface compression roller merely idling and without applying pressure.
Figure 3:
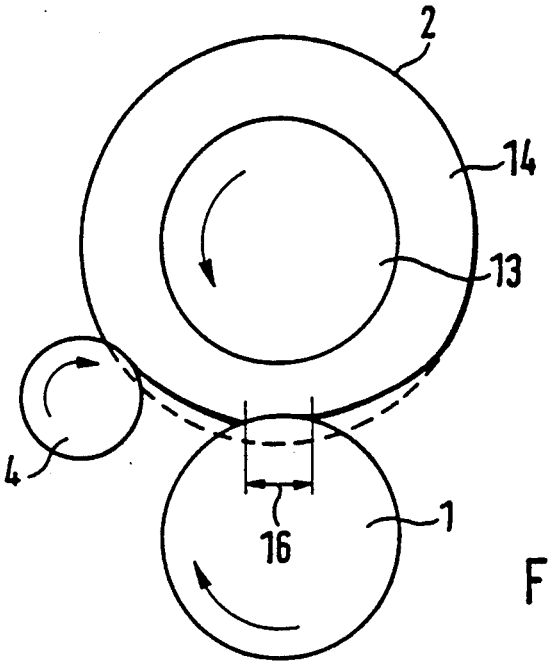
FIG. 3 is a view similar to FIG. 2 in which the surface compression roller applies surface pressure on the ink application cylinder, and in which the surface compression roller is located in advance of engagement with the ink supplying cylinder.
Figure 4:
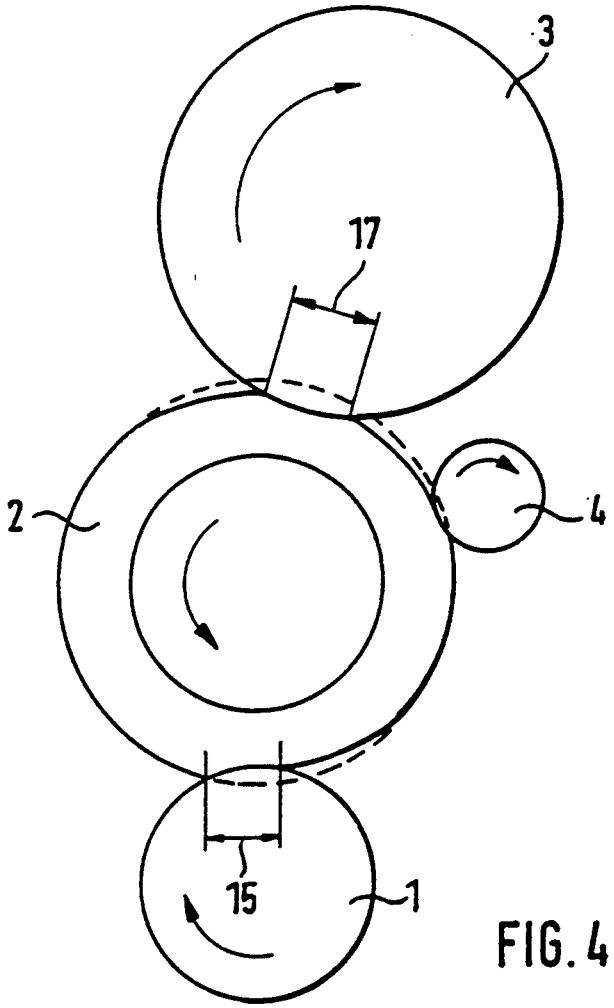
FIG. 4 is a view similar to FIG. 2 in which the surface compression roller is located in advance of the forme cylinder, and applies pressure on the ink application cylinder.

Control of ink transfer, with reference to FIGS. 2, 3 and 4:

FIG. 2 is a schematic representation of the deformation of the ink application roller 2 by the cellular roller 1, engaged against roller 2 under pressure, and with the auxiliary or compression roller 4 merely idling against the ink application cylinder 2, without surface compression thereagainst. The ink application roller 2 is formed of a core 13, for example of steel, and an elastic coating or jacket 14. The elastic coating or jacket may, for example, be a rubber layer or jacket. As seen, the ink application roller 2 is deformed by engagement with the cellular cylinder 1 at an engagement or ink transfer zone 15. The deformation depends on the elasticity characteristics of the material of the jacket 14, with respect to depth of compression, and hence the width of the engagement zone 15, as well as on the degree of relaxation of the compressible layer, that is, the distance and time of decay of the deformation and until the roller has, again, reached its nominal diameter. The deformation decays according to an e-function, and has decayed after a predetermined time, at the latest until the respective incremental area of the zone again meets the cellular cylinder 1. For ease of visualization, a broken line has been entered in FIG. 2 illustrating the nominal circumference of the cylinder 2, without deformation.

FIG. 3 illustrates, schematically, the deformation of the ink application roller 2 by the cellular roller 1 with the compression roller 4 in a first position, and compressively engaged against the ink application cylinder or roller 2. Looked at in the direction of rotation of the ink application cylinder 2, the surface is deformed first by the pressure engagement of the surface compression roller 4. This deformation of the layer 14 of the roller 2 decays within a predetermined time, that is, with reference to the ink application roller, within a predetermined circumferential distance on the roller.

The cellular roller 1 is located just downstream of the compression roller 4, preferably within a comparatively small distance. It, also, causes deformation of the circumference of the ink application roller 2. The deformation caused by the compression roller 4, however, has not yet decayed, so that the second deformation will be only along a small engagement or ink transfer zone 16, which is smaller and circumferentially shorter than when the compression roller is not in engagement, as shown in FIG. 2. Again, for ease of visualization, the circumference of the undeformed roller 2 is shown in broken lines. It can readily be seen that the width of the engagement zone 15 will depend on the depth of the deformation previously caused by the surface compression roller 4.

In accordance with another feature of the invention, the ink application cylinder 2 is engaged against a plate cylinder 3. The compression roller 4 is located in advance of the engagement of the ink application cylinder 2 with the plate cylinder 3, as seen in FIG. 4. Looked at in the direction of rotation of the ink application roller 2, it is first deformed by the compression roller 4, the deformation decaying within a predetermined time or, with respect to the roller when it rotates, within a predetermined distance at the circumference of the roller. The plate cylinder 3 is located behind the compression roller 4, preferably relatively closely thereto. It, also, causes deformation of the surface of the application roller 2. Since, however, the pre-deformation caused by the roller 4 has not yet decayed, the second deformation will not be fully effective so that the engagement or ink transfer zone 17 between the ink application roller 2 with the compressible yielding surface and the plate cylinder 3 will be less wide than without the presence or engagement of the compression roller 4. Again, and for better understanding, the circumference of the ink application roller 2, without deformation, is shown in broken line. The width of the engagement zone 17 depends on the depth of the pre-compression of the surface caused by the roller 4.

The exact values, which determine the dependency of the change of the width of the zone 16 or 17 of the ink application roller 2 with respect to the width of the engagement zone 15 or 17, respectively, will depend on the pressure exerted by the pressure roller 4 against the elastic layer 14. This relationship depends on the behavior of the visco-elastic layer 14, which is yielding, resiliently compressible. A few experiments will readily determine suitable engagement pressures for the pressure or compression roller 4 so that the width of the respective engagement or ink transfer zone 16 or 17 can be determined to provide for the requisite transfer of ink, not too much and not too little.

Figure 5:
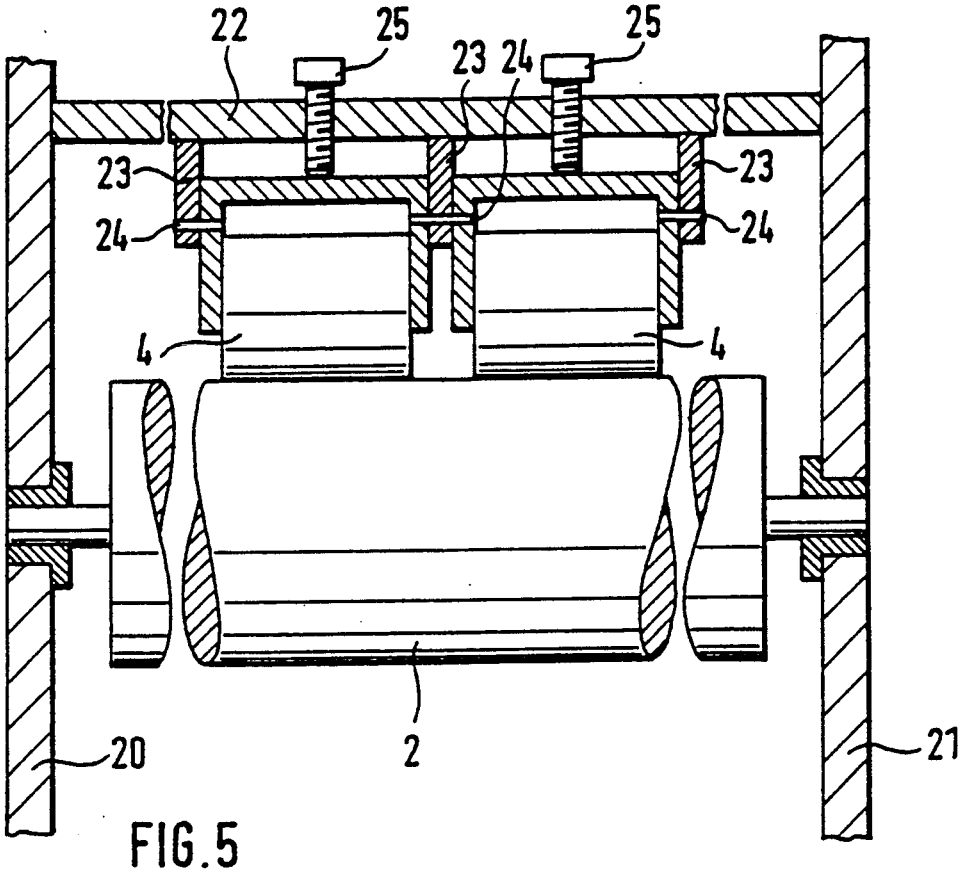
FIG. 5 is a highly schematic top view of an arrangement to supply ink in different amounts on different axial regions of a printing machine cylinder.
Figure 6:
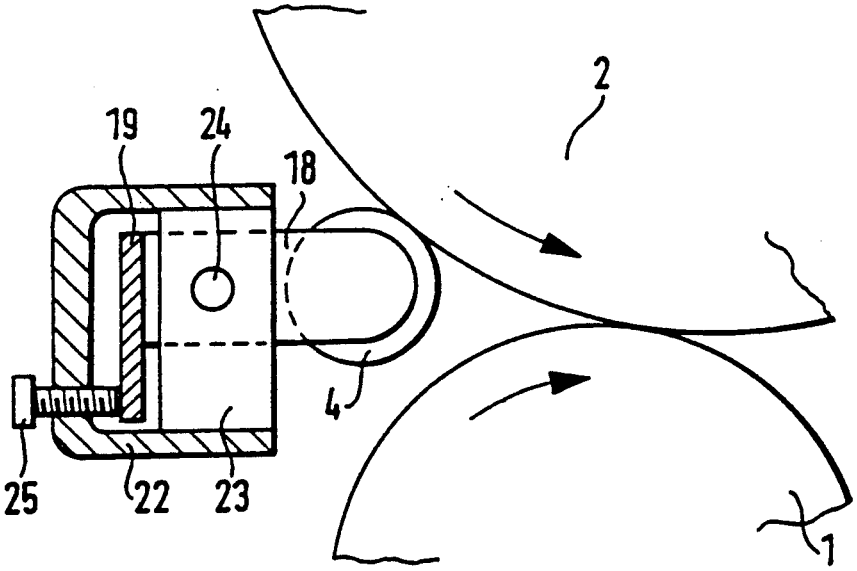
FIG. 6 is a schematic fragmentary side view of the apparatus of FIG. 5, omitting non-essential elements.

Use of pre-compression or surface compression rollers 4 located in advance of ink transfer from the ink application roller 2, but not extending over the entire width of the roller 2, can be used to provide different quantities of ink with respect to different axial zones of the ink application roller. FIGS. 5 and 6, highly schematically, illustrate a preferred embodiment of the arrangement for variable engagement of the surface compression roller 4 against the ink application roller 2.

As best seen in FIG. 5, the region in which ink is transferred between the ink application roller and another cylinder or roller is subdivided into a plurality of zones, of which, for example, two zones are shown in FIG. 5. A plurality of independently adjustable surface compression rollers 4 are engaged against the ink application roller 2. The number of zones, and hence the number of the pre-compression or surface compression rollers 4 is freely selectable. Since each of the rollers 4 is similarly supported and engaged, only one of the rollers will be described since the same description is equally applicable to all.

As seen in FIG. 6, the pre-compression roller 4 is retained in a generally U-shaped carrier 18, parallel to the ink application roller 2. The roller carrier 18 has two side legs, within which the pre-compression roller 4 can rotate. The carrier structure 18 for the pre-compression roller 4 is located in the interior space of a generally U-shaped cross rail 22 (FIG. 6), secured between the walls 20, 21 of the inker. The cross rail extends essentially parallel to the axis of rotation of the ink application roller 2. The roller carrier 18 is secured to the legs of the cross rail 22 by bearing box 23, secured to the cross rail for example by screws (not shown). The roller carrier 18 can pivot about an axis or shaft 24, parallel to the ink application roller 2. The center leg 19 of the U-shaped carrier 18 is elongated beyond the width of the side legs, so that, together with the side legs, it forms a double-arm lever, pivotable about the shaft 24. The lever need not necessarily be a right-angle lever. The center leg 19, thus, is extended so that applying pressure against the free end of the leg 19 causes application of pressure of the surface compression roller 4 against the ink application roller 2. This application of pressure, in the example of FIGS. 5 and 6, is obtained by engagement with an adjustment screw 25 passing through the connecting center portion of the cross rail 22. Upon screwing-IN of the screw 25, the roller 4 is engaged against the ink application roller 2 with increasing pressure; screwing-OUT of screw 25 lowers the engagement pressure until the roller 4 is removed from surface contact with the ink application roller 2, due to the weight of the roller 4 tending to hold the lever 19 in engagement with the screw 25 at all times.

The screw 25 can be operated, selectively, by hand, or can be automatically controlled. If automatic control is desired, the screw 25 is then preferably replaced by a spindle driven by an electric motor, for example a stepping motor.

Figure 7:
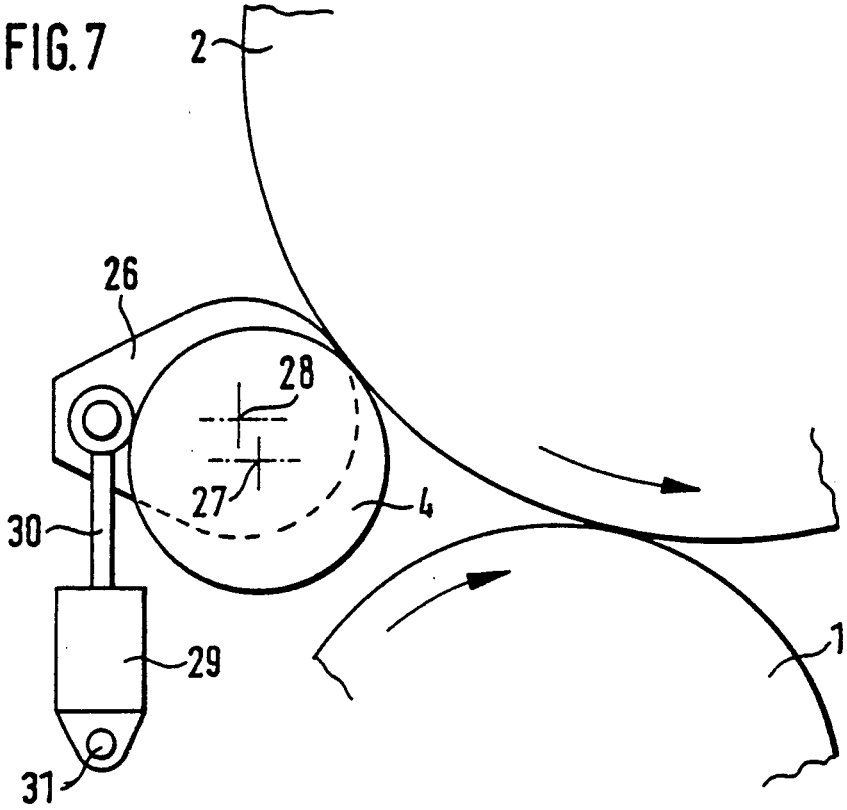
FIG. 7 is a schematic side view of apparatus to control engagement pressure by a pneumatic cylinder.
Figure 8:
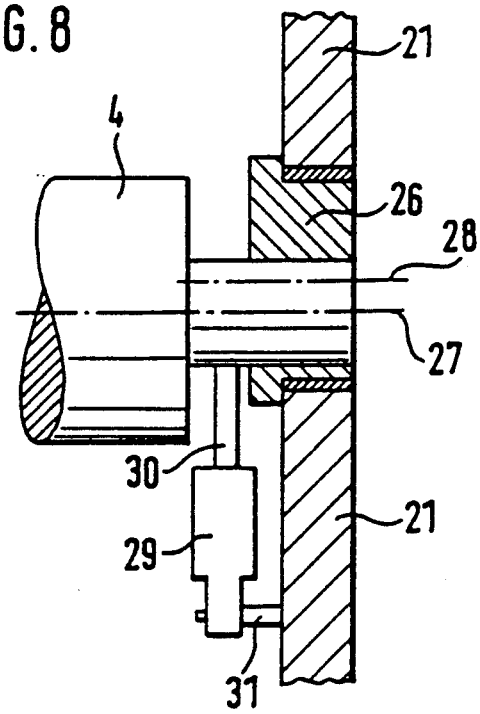
FIG. 8 is a fragmentary part-sectional side view of the apparatus of FIG. 7.

FIGS. 7 and 8, schematically, show another and suitable and desirable embodiment to change the engagement pressure of the surface compression roller on the ink application roller 2. The surface engagement roller 4 is rotatable about a shaft 27 in an eccentric 26. Shaft 27 is parallel to the axis of the ink application roller 2. The eccentric 26 is pivotable about an eccentric bearing 28, having a rotation axis parallel to the axis of rotation of the ink application roller 2. A pneumatic cylinder 29, coupled by a rod 30 with the eccentric 26, permits pivoting of the eccenter 26; in dependence on the direction of pivoting, the pressure roller 4 is engaged more or less against the ink application roller 2. Upon release of pressure in the unit 29, the roller 4 will be out of contact with the roller 2.

FIG. 8 illustrates the arrangement, partly in section, which shows specifically that the pneumatic cylinder 29 is pivotably secured to a side wall 21 of the inker with a pivot bolt 31. The piston cylinder unit 29 can be controlled, as well known, by suitable control systems, not shown.

The inker of the present invention, and particularly inkers with zone engagement rollers, has the advantage that the cellular roller can have a hard surface, so that it has a long life and is not easily worn. The ink application roller, in contrast, is formed with an elastically compressible surface, as is customary in inkers of many constructions. The plate cylinder, usually, also has a hard surface. The roller sequence, thus, hard-yielding-hard surface, customary in inkers of this type, can be retained and, yet, the quantity of ink being transferred can be easily controlled.

Various changes and modifications may be made, and any features described herein may be used with any of the others, within the scope of the inventive concept.

I claim:

1. An inker system for a printing machine having a rotatable ink transfer cylinder or roller (2) having a yieldingly compressible surface (14);

a rotatable ink supplying cylinder (1) having a cellular surface in operative engagement with the ink transfer cylinder or roller (2), said ink transfer cylinder or roller (2) engaging said ink supplying cylinder (1) at a first ink transfer station (15, 16); and a rotatable further cylinder (3) in operative engagement with said ink transfer cylinder or roller (2) to receive ink therefrom, said ink transfer cylinder or roller (2) engaging said further cylinder (3) at a second ink transfer station (17), comprising, in accordance with the invention, means for controlling the quantity of ink being transferred at a respective one of the ink transfer zones, said ink quantity transfer control means including a rotatable surface compression roller (4) in engagement with the yielding surface (14) of the ink transfer cylinder or roller (2) located, with respect to the direction of rotation of said ink transfer cylinder (2) closely in advance of at least one of said ink transfer zones (15, 16; 17); and means (5; 18, 19, 25; 26–31) for selectively controlling the engagement pressure of the surface compression roller on said yieldingly compressible surface (14) of the ink transfer cylinder or roller (2) for deforming said compressible surface (14) in advance of the respective ink transfer zone (15, 16; 17) to control the circumferential width of the respective ink transfer zone and thereby the quantity of ink being transferred at the respective ink transfer zone.

2. The system of claim 1, wherein said further cylinder comprises a plate cylinder (3).

3. The system of claim 1, wherein said surface compression roller (4) is located, with respect to the direction of rotation of said ink transfer cylinder (2), closely in advance of the first ink transfer zone (15, 16) between said ink transfer cylinder (2) and said ink supplying cylinder (1) having said cellular surface.

4. The system of claim 3, wherein said further cylinder comprises a plate cylinder (3).

5. The system of claim 1, wherein said surface compression roller (4) is located, with respect to the direction of rotation of said ink transfer cylinder (2), closely in advance of the second ink transfer zone (17) of said ink transfer cylinder (2) with said further cylinder (3).

6. The system of claim 5, wherein said further cylinder comprises a plate cylinder (3).

7. The system of claim 1, wherein a plurality of surface compression rollers (4) are provided, located axially adjacent each other and extending across respective axial zones of said ink transfer cylinder or roller (2).

8. The system of claim 7, wherein a plurality of selective engagement pressure control means (5; 18, 19, 25; 26–31) are provided, each individually associated with one of said plurality of surface compression rollers for independently selectively adjusting the engagement pressure of the respective surface compression roller (4) on a zone of the yieldingly compressible surface (14) of said ink transfer cylinder or roller (2).

9. The system of claim 1, wherein said engagement pressure control means comprises a pivot lever (7) rotatable about a pivot (6), the surface compression roller (4) being rotatably secured at one end of said pivot lever (7) and piston-cylinder means (8) pivotably coupled to said pivot lever.

10. The system of claim 9, wherein said pivot lever is a one-arm lever, and the pivot axis (6) is located at the second end of said pivot lever, said cylinder-piston system being pivotably coupled to the pivot lever intermediate its longitudinal dimension.

11. The system of claim 1, wherein said engagement pressure control means comprises a cross rail (22) extending between side walls (20, 21) of the inker;

a pivotable roller support element (18) pivotably retained on said cross rail (18);

and engagement screw means (25) engageable with said compression roller support element for selectively pivoting said support element about a pivot axis (24), said pivot axis extending essentially parallel to said ink transfer cylinder (2).

12. The system of claim 1, wherein said engagement pressure control means comprises (FIGS. 7, 8)

an eccentric (26), pivotable about an eccentric axis (28);

eccentric adjustment means (29, 30) positioning said eccentric; and wherein said surface compression roller (4) is located in said eccentric for rotation about an axis offset with respect to said eccentric axis.

13. The system of claim 12, wherein said eccentric adjustment means comprises a fluid pressure cylinder-piston system (29), and coupling means (30) coupling said cylinder-piston system to the eccentric.

14. A method of controlling the amount of ink transferred between a rotatable ink transfer cylinder or roller (2) of a printing machine and at least one rotatable cylinder or roller of the printing machine, wherein said ink transfer cylinder or roller (2) has a yielding compressible surface (14);

said printing machine having a rotatable ink supplying cylinder (1) having a cellular surface in operative engagement with the ink transfer cylinder or roller (2), the ink transfer cylinder or roller (2) engaging the ink supplying cylinder at a first ink transfer zone (15, 16); and a further rotatable cylinder (3) in operative engagement with said ink transfer cylinder or roller (2) to receive ink therefrom, said ink transfer cylinder or roller engaging the further cylinder (3) at a second ink transfer zone (17);

comprising placing said ink transfer cylinder (2) and at least one rotatable cylinder or roller in operative engagement wherein said at least one rotatable cylinder or roller includes at least one of: said ink supplying cylinder (1) having said cellular surface, and said further cylinder (3), and further comprising the steps of controlling the quantity of ink being transferred at the respective ink transfer zones (15, 16; 17) by controllably pre-compressing said yieldingly compressible surface closely in advance of at least one of said ink transfer zones (15, 16; 17) of said ink transfer cylinder (2) with said at least one cylinder, and permitting said yieldingly compressible surface to expand for a limited controlled amount before engagement with said at least one cylinder, by deforming said compressible surface (14) in advance of the respective ink transfer zone (15, 16; 17) to control the circumferential width of the respective ink transfer zone and thereby the quantity of ink being transferred at the respective ink transfer zone.

15. The method of claim 14, wherein said further cylinder comprises a plate cylinder (3).

16. The method of claim 14, wherein said step of pre-compressing said yieldingly compressible surface (14) comprises positioning a surface compression roller (4) closely in advance of at least one of said ink transfer zones (15, 16; 17);

applying said surface compression roller (4) against said yieldingly compressible surface; and controlling the engagement pressure between said surface compression roller (4) and said yieldingly compressible surface (14) of the ink transfer roller (2).

17. The method of claim 16, wherein said surface compression roller (4) is located, with respect to the direction of rotation of said ink transfer cylinder (2), in advance of engagement of said ink transfer cylinder (2) with said ink supplying cylinder (1) having said cellular surface.

18. The method of claim 17, wherein said further cylinder comprises a plate cylinder (3).

19. The method of claim 16, wherein said surface compression roller (4) is located, with respect to the direction of rotation of said ink transfer cylinder (2), in advance of engagement of said ink transfer cylinder (2) with said further cylinder (3).

20. The method of claim 19, wherein said further cylinder comprises a plate cylinder (3).

* * * * *